US005731010A

United States Patent [19]

Kikutani et al.

[11] Patent Number: 5,731,010

[45] Date of Patent: Mar. 24, 1998

[54] SPINNERET FOR MANUFACTURING MODIFIED CROSS-SECTION FIBERS WITH OPTICAL FUNCTION

[75] Inventors: Takeshi Kikutani, Tokyo; Katsumi Morohoshi, Yokosuka; Susumu Shimizu, Hadano; Akio Sakihara, Isehara; Kinya Kumazawa, Yokosuka; Hiroshi Tabata, Yokohama, all of Japan

[73] Assignees: Nissan Motor Co., Ltd., Yokohama; Tanaka Kikinzoku Kogyo K.K., Tokyo, both of Japan

[21] Appl. No.: 602,057

[22] Filed: Feb. 15, 1996

[30] Foreign Application Priority Data

Feb. 16, 1995 [JP] Japan ..... 7-028521

[51] Int. Cl.[6] ..... B29C 47/12

[52] U.S. Cl. ..... 425/131.5; 425/461; 264/171; 264/172.13; 264/177.13

[58] Field of Search ..... 425/131.5, 461; 264/171, 171.1, 172.13, 172.15, 177.13

[56] References Cited

U.S. PATENT DOCUMENTS

| | | | |
|---|---|---|---|
| 3,156,607 | 11/1964 | Strachan | 264/177.13 |
| 3,226,795 | 1/1966 | Swerdloff et al. | 264/177.13 |
| 3,249,669 | 5/1966 | Jamieson | 264/177.13 |
| 3,344,472 | 10/1967 | Kitajima et al. | 425/131.5 |
| 3,546,328 | 12/1970 | Lodge et al. | 425/131.5 |
| 3,650,659 | 3/1972 | Stapp | 264/177.13 |
| 4,343,604 | 8/1982 | Minjolle | 425/461 |
| 4,687,610 | 8/1987 | Vasilatos . | |
| 4,722,819 | 2/1988 | Lundsager | 425/461 |
| 5,407,738 | 4/1995 | Tabata et al. . | |

FOREIGN PATENT DOCUMENTS

| | | | |
|---|---|---|---|
| 0 207 705 | 1/1987 | European Pat. Off. . | |
| 0 496 394 | 7/1992 | European Pat. Off. . | |
| 44-13208 | 6/1969 | Japan . | |
| 46-3816 | 1/1971 | Japan . | |
| A-7214763-R | 5/1972 | Japan | 425/131.5 |
| 62-25766 | 6/1987 | Japan . | |
| 5-25705 | 2/1993 | Japan . | |
| 6-17349 | 1/1994 | Japan . | |
| 2 153 803 | 8/1985 | United Kingdom . | |

*Primary Examiner*—Jay H. Woo
*Assistant Examiner*—Iurie A. Schwartz
*Attorney, Agent, or Firm*—Foley & Lardner

[57] ABSTRACT

A spinneret for manufacturing modified cross-section fibers with optical function includes a middle spinneret for spinning an island portion, which has a base and an opening for extruding a melt polymer for forming an island portion. A partition device is mounted to the middle spinneret to partition the opening thereof, the partition device having an opening communicating with the opening of the middle spinneret which protrudes-from the base thereof.

15 Claims, 6 Drawing Sheets

SPINNERET FOR MANUFACTURING MODIFIED CROSS-SECTION FIBERS WITH OPTICAL FUNCTION

BACKGROUND OF THE INVENTION

The present invention relates generally to a spinneret for manufacturing fibers with new optical function and more particularly, to a spinneret for manufacturing modified cross-section fibers with optical function, which serves, in particular, to spin island portions which constitute together with a sea portion an islands-in-a-sea type fiber with optical function for reflecting ultraviolet (UV) or infrared (IR) ray or showing colors by reflection, interference, diffraction or scattering phenomena of visible light ray.

Recently, in compliance with a demand for high fabric quality, many sensory fibers are manufactured which have not a simple round cross section, but a modified cross section to obtain improved properties such as luster and texture. Generally, in view of difficulty of being obtained from a single component, such fibers are made of melt spinning which comprises two or more polymeric components, using as a spinneret a nozzle with an opening in modified shape. Moreover, various improvements are performed in the shape of the modified nozzle, the design of passages up to the modified nozzle and extrusion openings, etc.

JP 44-13208 discloses a polymer arrayal or fiber spinning equipment wherein a composite spinning for forming a composite flow is obtained by extruding one component from tubes for leading a melt polymer, which corresponds to island portions, and the other component from middle spinneret through porous portions thereof, arranged around the tubes and using a porous material, which corresponds to a sea portion. This is featured by the use of the porous material for the spinneret for extruding the other component. Moreover, formed fibers have a cross section wherein the island portions of the one component are dispersed in the sea portion of the other component, having expected improvement not only in the fiber characteristic such as luster and texture, but in the mechanical properties.

JP 46-3816 and JP-B2 62-25766 disclose a manufacturing of islands-in-a-sea type multicomponent fibers having a modified cross section. In the former document, tubes of a spinneret which serve to form island portions have an opening in the middle thereof, into which flows a part of polymer for forming a sea portion, obtaining an islands-in-a-sea cross section with two components arranged in layer. On the other hand, the latter document is featured, particularly, by the shape of a cross section of island portions which is in a wedge, cross, etc. Moreover, for preventing a lowering of fluid pressure of the other component flowing between the tubes and a reduction in extrusion irregularity thereof, this document recommends less number of tubes.

JP-A 5-25705 discloses a spinneret for obtaining a laminated structure arranged symmetrically in the longitudinal direction of fibers by removing a confluence and collision of mulled composite flows. As for the number of openings of a spinneret and the arrangement thereof, this document recommends a disc spinneret having approximately 300–2,500 openings arranged concentrically.

The above spinnerets provide composite fibers with a modified cross section improved in the fiber characteristic such as luster and texture and the machine characteristic, but cannot form fibers with a complicated modified cross section having an optical dimension for presenting the optical function.

Examples of the known spinneret will be described briefly. In a spinneret of the dispersed island type, a melt polymer for forming island portions passes through tubes held by upper and middle spinnerets. At the same time, a melt polymer for forming a sea portion passes through a passage arranged in the upper spinneret, and it is accumulated in a space between the upper and middle spinnerets. The middle spinneret is made of a porous material, so that the melt polymer for forming a sea portion is uniformly extruded, together with the melt polymer for forming island portions, to a funnel-shaped spinneret so as to come to a discharge opening. The modified shape of island portions is obtained by changing the shape of a discharge opening of each tube and the discharge opening of the funnel-shaped spinneret. This method is effective in a modification of the shape of island portions, but does not allow a modification of the shape for obtaining the optical characteristic due to simple shape of the tubes.

In another known spinneret, a melt polymer for forming island portions is led to tubes through a distribution plate with a filter. A melt polymer for forming a sea portion is accumulated in a space between upper and lower plates through passages, and is led to the tubes through inlets for melt polymer. Subsequently, the melt polymer is extruded, without being mixed, to funnel-shaped portions of a spinneret plate through extrusion openings, and is ejected from extrusion openings. This known spinneret can slightly modify the shape of island portions, however, it relates to a method of improving the drawing when using a fragile amorphous polymer to islands, and does not allow the shape of island portions with the optical dimension necessary to present the optical function.

On the other hand, today's society, which is considered as sensory society connected to near future intelligent society, has a big demand for high visual quality of consumer products. In the field of fibers, there is a demand for functional fibers which go further than an improvement in fabric properties as described above. The materialization of fibers is waited, having, e.g. impressive colors and reflection function of ultraviolet ray which prevents a degradation of fibers or that of infrared ray which is useful for hot insulation without carrying out any special treatment of fiber materials. This is not possible by the known method of forming modified cross-section fibers, particularly, by using the known spinneret.

Thus, for a forming of modified cross-section fibers, a design of a spinneret for controlling the shape of extruded polymer and a method of using same are very important factors. The form of a modified cross section of fibers should ensure a predetermined optical dimension for obtaining the above optical function. As being extremely complicated, such form of a modified cross section with optical dimension belongs in ultimate arts.

JP-A 6-017349 (U.S. Pat. No. 5,407,738) discloses modified cross-section fibers having a laminated portion of dissimilar materials, and reflecting ultraviolet or infrared ray or showing colors by reflection of visible light ray. As described in this document, parallel fin portions of a modified cross section and their peripheries serve to reflect ultraviolet or infrared ray or visible light ray due to optical dimension of a sea portion and an air layer, for example, to present a predetermined or desired optical function. It is, however, very difficult to form such modified cross-section fibers.

It is, therefore, an object of the present invention to provide a spinneret which can manufacture efficiently modified cross-section fibers with multioptical function.

SUMMARY OF THE INVENTION

According to one aspect of the present invention, there is provided a spinneret for manufacturing modified cross-section fibers with a first portion and a second portion surrounding the first portion out of melt polymers for forming the first and second portions, the spinneret comprising:

a spinning member serving to spin the first portion, said spinning member having a base and an opening for extruding the melt polymer for forming the first portion; and a partition device mounted to said spinning member, said partition device serving to partition said opening of said spinning member, said partition device having an opening communicating with said opening of said spinning member, said opening of said partition device protruding from said base of said spinning member.

Another aspect of the present invention lies in providing a spinneret for manufacturing modified cross-section fibers with a first portion and a second portion surrounding the first portion out of melt polymers for forming the first and second portions, the spinneret comprising:

means for spinning the first portion, said spinning means having a base and an opening for extruding the melt polymer for forming the first portion; and means for partitioning said opening of said spinning means, said partitioning means having an opening communicating with said opening of said spinning means, said opening of said partitioning means protruding from said base of said spinning means.

DETAILED DESCRIPTION OF THE INVENTION

Figure 1:
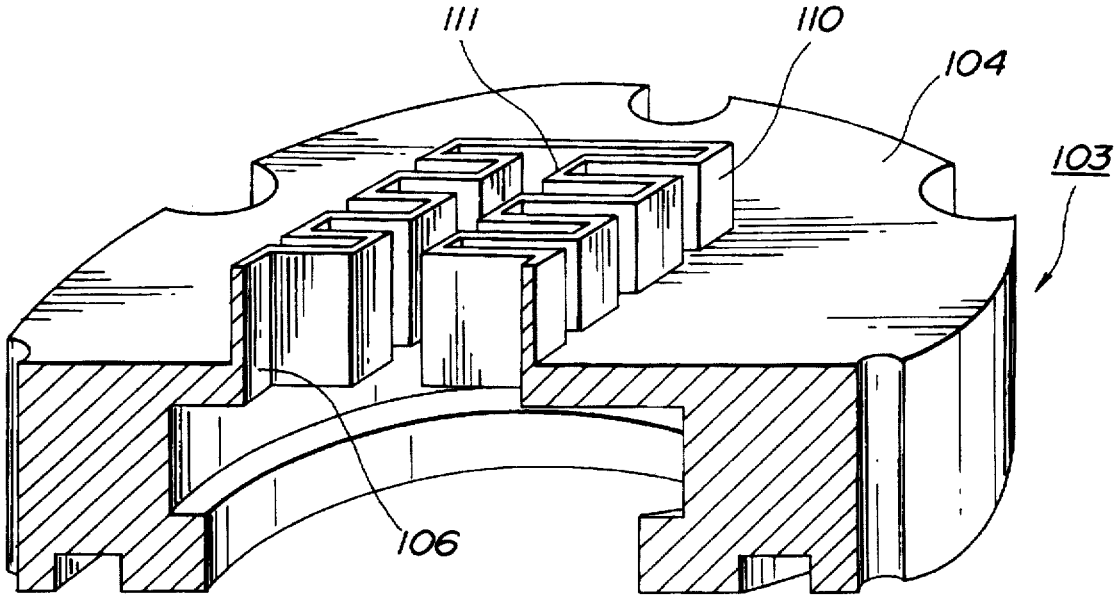
FIG. 1 is perspective sectional view showing a first preferred embodiment of a spinneret for manufacturing modified cross-section fibers with optical function according to the present invention.

Referring to the drawings, a description will be made with regard to preferred embodiments of a spinneret for manufacturing modified cross-section fibers with optical function.

Referring first to FIG. 1, a spinneret for manufacturing modified cross-section fibers with optical function will be described sketchily. This spinneret, designated generally by reference numeral 103, is a middle spinneret which has a polymer extrusion side as shown in FIG. 1. It is noted that when forming modified cross-section fibers, passages of two melt polymers with different properties for forming island and sea portions are ensured separately up to a predetermined confluent point.

Examples of melt polymers to which the present invention is applicable are ordinary melt thermoplastic polymers including polyolefines such as polyethylene and polypropylene, polyesters such as poly(ethylene terephtalate) and poly(tetramethylene terephtalate), polystyrene, polycarbonate, poly(fluoroethylene), polyacetal, poly(phenylene sulfide), etc. Copolymers and mixed polymers having two or more of the above polymers can also be used at their melting temperature. For obtaining the optical function, an islands-in-a-sea structure should be formed out of two substances with a predetermined dimension, which correspond to two of the above materials, or one thereof and air which corresponds to a sea portion.

Referring to FIG. 1, the middle spinneret 103 includes a base 104 formed with a polymer opening 106. Arranged to the base 104 on the polymer extrusion side is a partition device 110 for controlling a passage for an island portion, having an opening with the shape identical to that of the polymer opening 106 or enough large to enclose the polymer opening 106.

Due to a structure that a polymer extrusion opening 111 of the partition device 110 is not on the same plane with a surface of the base 104 of the middle spinneret 103, a melt polymer for forming an island portion is surrounded by a melt polymer for forming a sea portion when extruded from the polymer extrusion opening 111, enabling formed fibers to preserve a predetermined modified cross section.

The modified shape of an island portion for obtaining the optical function of reflection of ultraviolet or infrared ray, or reflection and interference of visible light ray is described in detail in JP-A 6-017349 (U.S. Pat. No. 5,407,738) which is incorporated herein for reference. Here, it is noted that fibers show different optical function fundamentally in accordance with their application form, i.e. a modified cross section with both island and sea portions, or with only an island portion.

Thus, referring to FIGS. 2A–2E, when forming fibers having a modified cross section with island and sea portions, the opening of the partition device 110 for controlling a passage for an island portion may be an opening with parallel slits, or an opening with parallel slits 112 and a center slit 106A perpendicular thereto as shown in FIGS. 2A–2E. As for the opening as shown in FIGS. 2A–2E, it is preferable to satisfy the relation of $3W_2 \leqq W_3$ wherein $W_2$:width of the center slit 106A; $W_3$:length of the parallel slits 112, since modified cross-section fibers formed through the opening as shown in FIGS. 2A–2E allow incident light to have the length enough to present reflection and interference. It is noted that in FIGS. 2A–2E, the shape of the opening of the partition device 110 corresponds to that of the polymer opening 106.

On the other hand, when forming fibers having a modified cross section with only an island portion, a polymer for a sea portion is removed in any way after forming island-in-a-sea type fibers. Thus, with a lamellar island portion of fibers as seen in JP-A 6-017349 (U.S. Pat. No. 5,407,738), for holding parallel fin portions, the opening of the partition device 110 for controlling a passage for an island portion is an opening with parallel slits and a center slit perpendicular thereto as shown in FIGS. 2A–2E.

In such a way, fibers should preserve a predetermined regular shape to present the optical function. Specifically, a separation of the parallel fin portions and a preservation of the shape thereof are very important factors in the process from a melt polymer to fibers.

This is not possible, however, by the spinneret without the partition device 110 for controlling a passage for an island portion, i.e. the spinneret with only the known polymer opening. By way of example, fibers with optical function as seen in JP-A 6-017349 (U.S. Pat. No. 5,407,738) cannot be obtained since a melt polymer for forming an island portion flows into the base of the spinneret through the polymer opening, and the parallel fin portions of the melt polymer for forming an island portion stick to each other before being surrounded by a melt polymer for forming a sea portion.

On the other hand, with the middle spinneret 103 of the present invention, the partition device 110 for controlling a passage for an island portion is arranged to follow the polymer opening 106, a melt polymer for forming a sea portion which surrounds an island portion is fully accumulated in an outer peripheral portion of the partition device 110, then, a melt polymer for forming an island portion is extruded therein. Therefore, without any sticking of the parallel fin portions of the melt polymer for forming an island portion, and with the shape substantially similar to the shape for showing the optical function, the polymers are led to a spinning extrusion opening 107 (see FIG. 4) in the form of a composite flow.

As for the middle spinneret 103 as shown in FIG. 1, the shape of the polymer opening 106 of the base 104 is identical to that of the opening of the partition device 110 for controlling a passage for an island portion. Alternatively, referring to FIGS. 3A and 3B, the shape of the polymer opening 106 may be different from that of the opening of the partition device 110 as shown in FIG. 3A, or the shape of the two may be as shown in FIG. 3B.

Figure 3A:
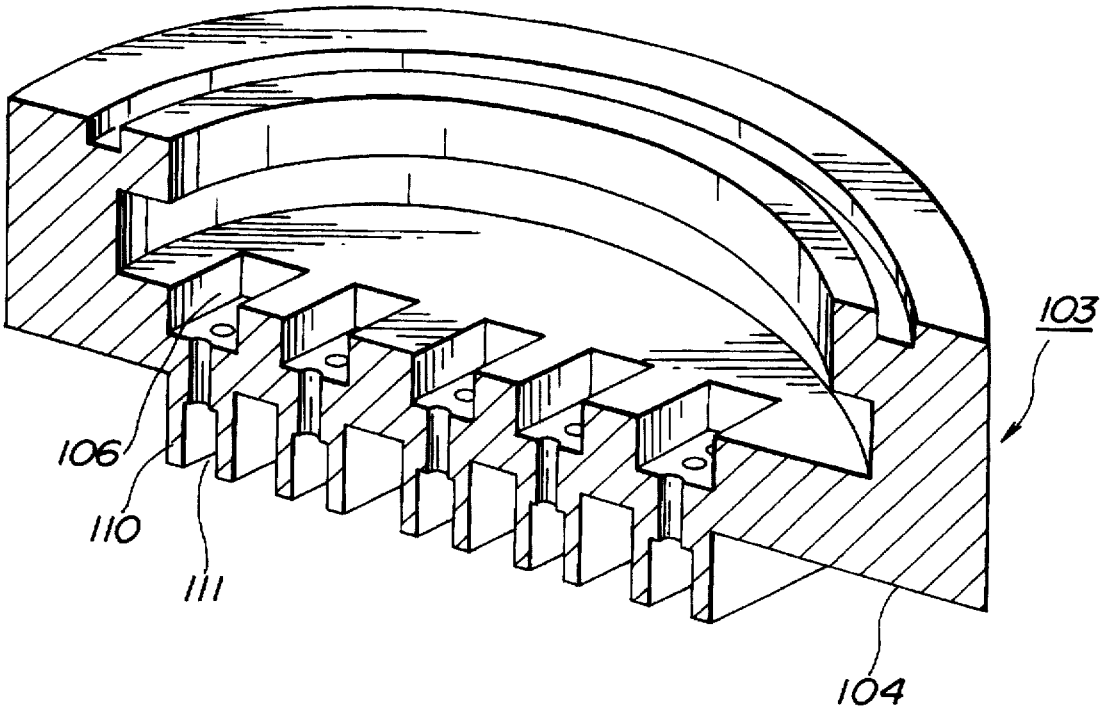
FIG. 3A is a perspective sectional view showing a second embodiment of the present invention.
Figure 3B:
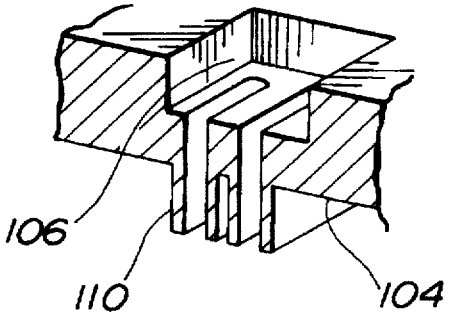
FIG. 3B is a fragmentary section showing a variant of the shape of a polymer extrusion opening of the spinneret.

Particularly, a difficulty of machining a long slit-shaped extrusion opening as shown in FIG. 3A is reduced by forming together therewith the polymer opening 106 having a circular bore. Specifically, a machining of the slit-shaped extrusion opening can be minimized by a forming of the circular bore, enabling the outside of the partition device 110 to have a sufficient height, resulting in a possible division of a melt polymer for forming a sea portion and that one for forming an island portion during a long period of time.

The height of the partition device 110 for controlling a passage for an island portion is not limited to a specific value, and it may have the same value in all portions thereof. However, referring to FIG. 4, in view of the fact that a melt polymer for forming an island portion can not only have a balanced extrusion amount, but be affected minimally by a funnel-shaped wall of a funnel-shaped spinneret 102 (as will be described later) with respect to a compression, the partition device 110 may have, in accordance with the shape of a concavity for melt polymers, i.e. the shape of the funnel-shaped spinneret 102, a length having an extent approximately up to a position at which funnel-like inclinations of the funnel-shaped spinneret 102 start, and gradually increased from the periphery of the middle spinneret 103 to a center thereof.

Figure 2A:
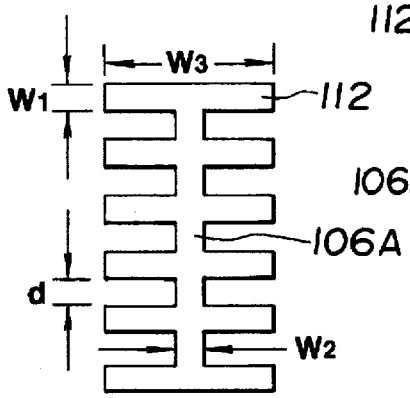
FIGS. 2A–2E are diagrammatic views showing examples of the shape of an opening of a partition device for controlling a passage for an island portion.
Figure 2B:
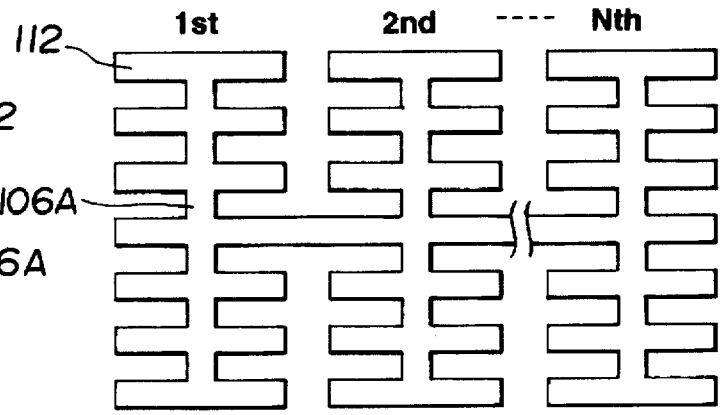
Figure 2C:
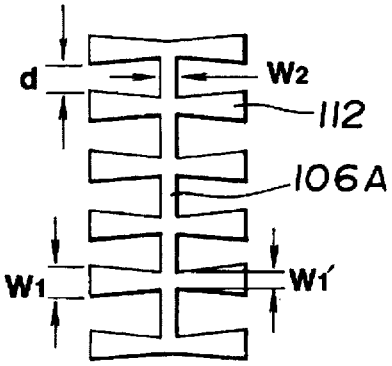
Figure 2D:
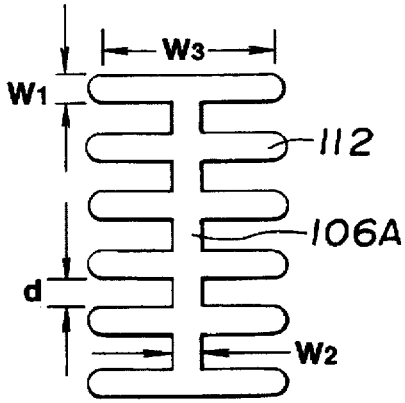
Figure 2E:
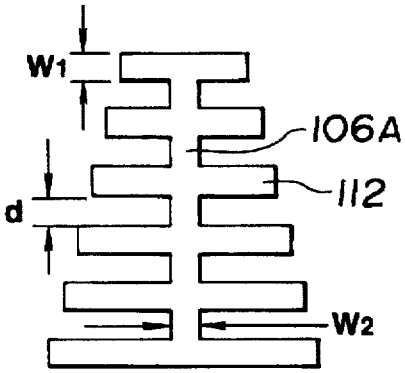

When constructed by parallel slits and a center slit perpendicular thereto, the openings of the polymer opening 106 and the partition device 110 for controlling a passage for an island portion is not limited to the opening as shown in FIG. 2A. Alternatively, the openings of the polymer opening 106 and the partition device 110 may be as shown in FIG. 2B including groups of parallel slits and a center slit, or as shown in FIG. 2C having wider ends of the parallel slits 112, or as shown in FIG. 2D having the parallel slits 112 shaped in an ellipse, or as shown in FIG. 2E having the length of the parallel slits 112 increased gradually from one end of the center slit 106A to the other end thereof.

Generally, when using the spinneret with parallel slits and a center slit perpendicular thereto, the melt polymer tends to be less supplied to ends of the parallel slits than an intersection of the parallel and center slits. Such tendency can be avoided by adopting the shape of the parallel slits 112 with wider ends as shown in FIG. 2C, resulting in improved transcription or ratio of the complexity of the cross section of fibers to that of the spinneret.

On the other hand, it is known that with increased thickness of an end portion of the partition device 110 for controlling a passage for an island portion, a greater amount of melt polymer is provided to the extrusion openings at the ends of the parallel slits. This effect is available for an increase in supply of melt polymer to the ends of the parallel slits.

Figure 4:
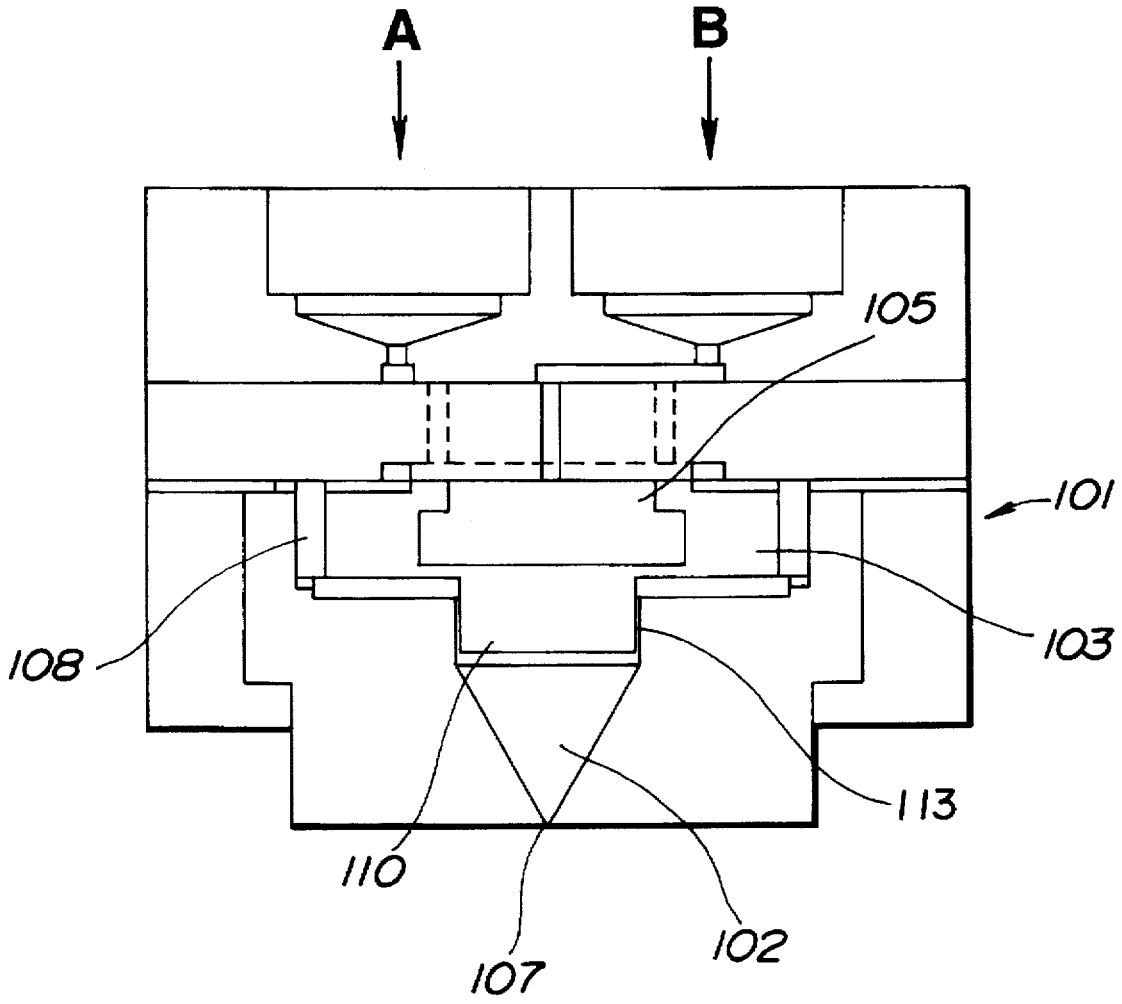
FIG. 4 is a schematic section showing a spinning equipment using the spinneret as shown in FIG. 1.

Referring to FIGS. 1 and 4, it is preferable that the interval between the partition device 110 for controlling a passage for an island portion and an upper portion 113 of the funnel-shaped spinneret 102 is as small as possible so that a melt polymer for forming a sea portion can sufficiently be distributed around the partition device 110, particularly, between parallel slit defining walls thereof.

In the above description, polymers serve as materials for forming sea and island portions, alternatively, air is usable as a sea member. In that case, modified cross-section fibers are obtained with only an island-portion, a sea portion being an air layer. Such fibers can be manufactured by the middle spinneret 103 of the present invention.

Figure 5A:
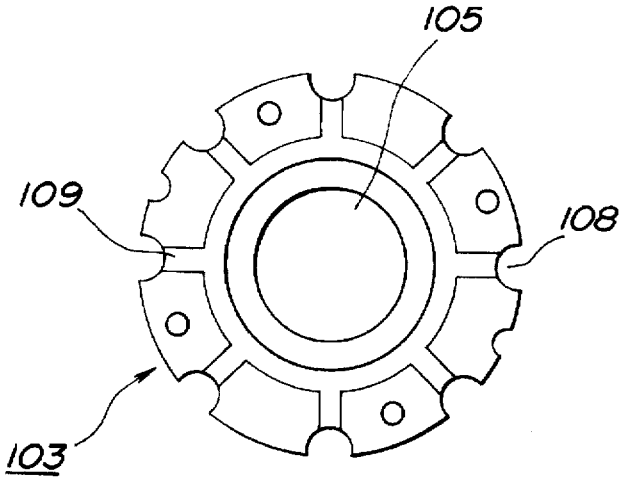
FIG. 5A is a plan view showing the spinneret.
Figure 5B:
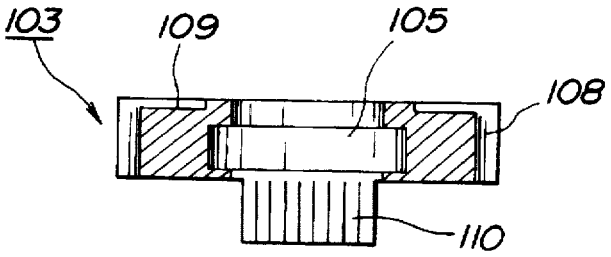
FIG. 5B is a sectional view showing the spinneret.
Figure 6:
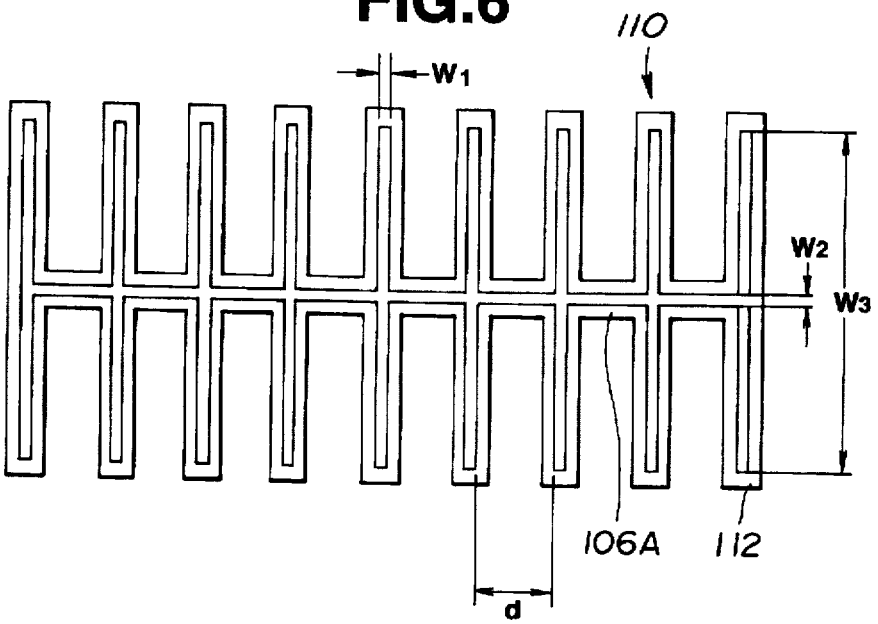
FIG. 6 is a diagrammatic view showing the shape of an opening of a partition device for controlling a passage for an island portion.

Referring to FIGS. 4–6, a first embodiment of the present invention will be described. Referring particularly to FIG. 4, in a packaged head 101, a melt polymer A for forming a sea portion is led, through passages 108 defined by the middle spinneret 103, to the funnel-shaped spinneret 102. A melt polymer B for forming an island portion is led, through a passage 105 formed in the middle spinneret 103 and the partition device 110 for controlling a passage for an island portion, to the funnel-shaped spinneret 102. Then, the melt polymers A, B which flow together are extruded from the spinning extrusion opening 107, obtaining island-in-a-sea type fibers.

Referring to FIGS. 5A and 5B, the middle spinneret 103 has in a center thereof the passage 105 for the melt polymer B for forming an island portion, which communicates with the partition device 110 for controlling a passage for an island portion. Moreover, the middle spinneret 103 has on a top thereof distribution passages 109 for the melt polymer A for forming a sea portion, which communicates with the passages 108 for the melt polymer A.

The opening of the partition device 110 for controlling a passage for an island portion is shaped as shown in FIG. 6. The width $W_1$ of the parallel slits 112 and the width $W_2$ of the center slit 106A are both 0.2 mm. The length $W_3$ of the parallel slits 112 is 7.8 mm, and the interval "d" between the parallel slits 112 is 1 mm. Moreover, the height of the partition device 110 is 8 mm.

Figure 7:
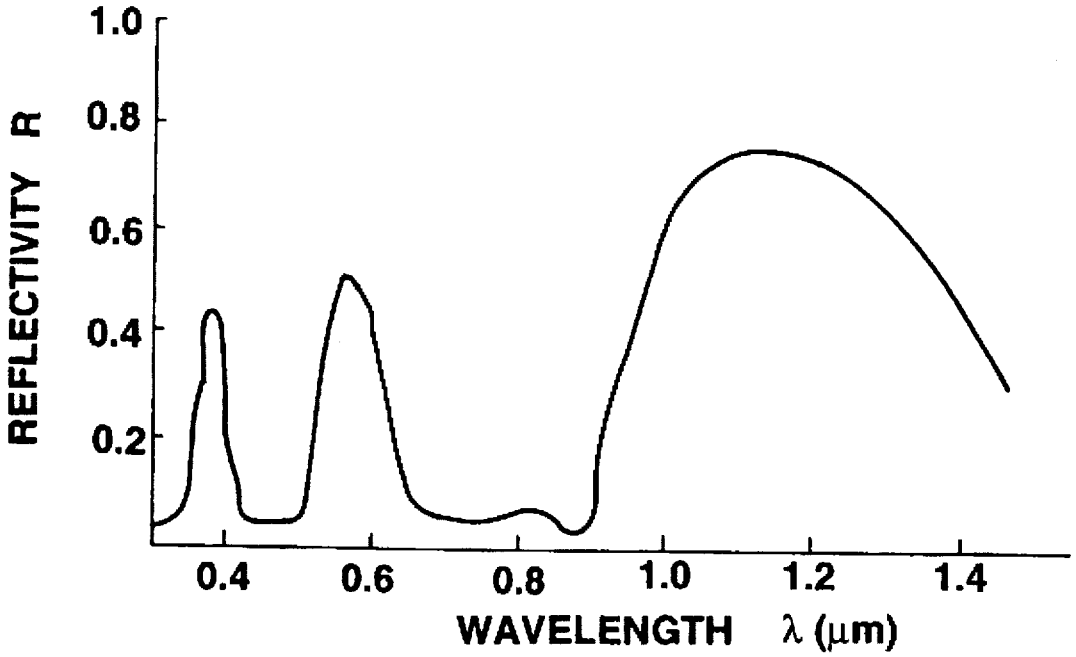
FIG. 7 is a graph illustrating the relation between the reflectivity and the wavelength for an island portion of fibers.

With the above spinning equipment, a spinning is carried out by using polystyrene (PS) as the melt polymer A for forming a sea portion and poly(ethylene terephthalate) (PET) as the melt polymer B for forming an island portion. Thus, island-in-a-sea type fibers are obtained having a modified cross section with an island portion which is substantially similar to the shape of the opening as shown in FIG. 6, the parallel fin portions being slightly narrower and roundish. Then, the reflection spectrum is measured with regard to a modified cross section with only an island portion, a sea member being dissolved and removed from formed fibers. This measurement reveals that formed fibers present the optical function substantially similar to that as shown in FIG. 7. As seen from FIG. 7, the parallel fin portions of a modified cross section and their peripheries can present a predetermined or desired optical function by reflecting ultraviolet and infrared rays and visible light ray for showing colors. For detailed information on the reflection spectrum as shown in FIG. 7, see JP-A 6-017349 (=U.S. Pat. No. 5,407,738). It will be understood that according to the first embodiment, the spinneret is provided which can manufacture efficiently modified cross-section fibers with multioptical function.

As described above, according to the first embodiment, the use of the partition device 110 for controlling a passage for an island portion contributes not only to an excellent preservation of the shape of fibers, by which the fibers can present a predetermined or desired optical function, but to an improvement in the quality and productivity of the fibers.

In the first embodiment, the thickness of the partition device 110 for controlling a passage for an island portion is 0.3 mm in any portion, which is not limitative, however.

Referring to FIG. 2C, a second embodiment of the present invention will be described. The second embodiment is substantially the same as the first embodiment except the partition device 110 for controlling a passage for an island portion. Specifically, the partition device 110 has an opening as shown in FIG. 2C, wherein the width $W_1$ of the parallel slits 112 at ends thereof and the width $W_1'$ of the parallel slits 112 at an intersection with the center slit 106A are 0.5 mm and 0.2 mm, respectively, the width $W_2$ of the center slit 106A is 0.5 mm, the interval "d" between the parallel slits 112 is 2.0 mm, and the number of the parallel slits 112 is nine.

An island portion of formed fibers have a shape nearer to the opening as shown in FIG. 6 than that of the fibers of the first embodiment, i.e. the fibers of the second embodiment show a higher transcription than those of the first embodiment.

As described above, according to the second embodiment, also, the use of the partition device 110 for controlling a passage for an island portion contributes not only to an excellent preservation of the shape of fibers, by which the fibers can present a predetermined or desired optical function, but to an improvement in the quality and productivity of the fibers.

Having described the present invention in connection with the preferred embodiments, it is noted that the present invention is not limited thereto, and various changes and modifications can be made without departing from the spirit of the present invention.

What is claimed is:

1. A spinneret for manufacturing multicomponent fibers with a first portion and a second portion surrounding the first portion, the first portion and the second portion being formed out of a melt polymer, the spinneret comprising:

a spinning member having a base formed with openings for extruding the melt polymers for forming the first portion and the second portion; and a partition device mounted to said spinning member, said partition device enclosing said opening for extruding the melt polymer for forming the first portion, said partition device having both ends open, said partition device protruding from said base of said spinning member in a direction of flow of the melt polymers, said partition device defining an opening which in cross section comprises a first group of first slits arranged parallel to each other and a second slit arranged to intersect said first slits.

2. A spinneret as claimed in claim 1, wherein said first slits have a same width and are disposed at regular intervals.

3. A spinneret as claimed in claim 1, wherein said opening of said partition device is formed to satisfy a relation of $3W_2 \leqq W_3$ wherein $W_2$ is a width of said second slit, and $W_3$ is a length of said first slits.

4. A spinneret as claimed in claim 2, wherein said first slits have a same length.

5. A spinneret as claimed in claim 2, said first slits have different lengths.

6. A spinneret as claimed in claim 5, wherein said first slits have lengths that increase gradually from one end of said second slit to an opposite end of said second slit.

7. A spinneret as claimed in claim 1, wherein said partition device has the same height in all portions thereof.

8. A spinneret as claimed in claim 1, wherein said partition device has a height that increases gradually from a periphery of said spinning member to a center of said spinning member.

9. A spinneret as claimed in claim 4, wherein said first slits are shaped in a rectangle.

10. A spinneret as claimed in claim 4, wherein said first slits are shaped in a rectangle with semi-circular ends.

11. A spinneret as claimed in claim 9, wherein said first slits are wider at ends than at an intersection of with said second slit.

12. A spinneret as claimed in claim 11, wherein said first group of first slits is connected to a second group, of first slits by a connecting slit.

13. A spinneret as claimed in claim 12, wherein said connecting slit is placed in a middle of said first slits.

14. A spinneret for manufacturing multicomponent fibers with a first portion and a second portion surrounding the first portion, the first portion and the second portion being formed out of a melt polymer, the spinneret comprising:

means for spinning the first portion and the second portion, said spinning means having a base formed with openings for extruding the melt polymers for forming the first portion and the second portion; and means for partitioning said opening of said spinning means for extruding the melt polymer for forming the first portion, said partitioning means having both ends open, said partitioning means protruding from said base of said spinning member in a direction of flow of the melt polymers, said partitioning means defining an opening which in cross section comprises a first group of first slits arranged parallel to each other and a second slit arranged to intersect said first slits.

15. A spinneret for manufacturing a fiber including a portion comprising two first members facing each other through an air gap and a second member for connecting the two first members, the portion being formed out of a melt polymer, the spinneret comprising:

a spinning member having a base formed with an opening for extruding the melt polymer; and a partition device mounted to said spinning member, said partition device having both ends open, said partition device protruding from said base of said spinning member in a direction of flow of the melt polymer, said partition device defining an opening which in cross section comprises a first group of first slits arranged parallel to each other and a second slit arranged to intersect said first slits.

* * * * *

UNITED STATES PATENT AND TRADEMARK OFFICE

CERTIFICATE OF CORRECTION

PATENT NO. : 5,731,010
DATED : March 24, 1998
INVENTOR(S) : Kikutani, et al

It is certified that error appears in the above-identified patent and that said Letters Patent is hereby corrected as shown below:

On the title page, under item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 5 | 5 | 1 | 2 | 7 | 9 | 12-29-70 | Ando et al. | | | |
| | | | | | | | | | | | | | |

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 1 | 7 | 8 | 5 | 2 | 0 | 9 | 05-04-72 | Federal Republic of Germany | | | | |
| | | 0 | 3 | 9 | 9 | 3 | 9 | 7 | 11-28-90 | European Patent Office | | | | |
| | | | | | | | | | | | | | | |

UNITED STATES PATENT AND TRADEMARK OFFICE

CERTIFICATE OF CORRECTION

PATENT NO. : 5,731,010

DATED : March 24, 1998

INVENTOR(S) : Kikutani, et al

It is certified that error appears in the above-identified patent and that said Letters Patent is hereby corrected as shown below:

OTHER DOCUMENTS

| | | |
|---|---|---|
| | | Hansen, H., "Verschiedenartiger Glanz von Textilien durch Einsatz von Chemiefasern," |
| | | *Chemiefasern*, December 1968, pp. 926-928. |
| | | Patent Abstracts of Japan, JP 62-97909, C-451, Vol. 11, No. 31, October 14, 1987 |
| | | |

Signed and Sealed this

Second Day of March, 1999

*Attest:*

*Attesting Officer*

Q. TODD DICKINSON

*Acting Commissioner of Patents and Trademarks*